US010961698B1

(12) United States Patent
Rampey et al.

(10) Patent No.: US 10,961,698 B1
(45) Date of Patent: Mar. 30, 2021

(54) BRACKET ASSEMBLY AND INSTALLATION METHOD FOR INTERCONNECTING STUD WALLS IN A STACKED RELATIONSHIP

(71) Applicant: M.C. Dean, Inc., Tysons, VA (US)

(72) Inventors: Walter Edward Rampey, Leesburg, VA (US); Mengze Niu, Reston, VA (US)

(73) Assignee: M.C. DEAN INC., Tysons, VA (US)

( * ) Notice: Subject to any disclaimer, the term of this patent is extended or adjusted under 35 U.S.C. 154(b) by 0 days.

(21) Appl. No.: 16/706,385

(22) Filed: Dec. 6, 2019

(51) Int. Cl.
*E04B 1/61* (2006.01)
*E04B 2/00* (2006.01)
*E04B 2/72* (2006.01)

(52) U.S. Cl.
CPC ..... *E04B 1/61* (2013.01); *E04B 2/721* (2013.01); *E04C 2/46* (2013.01)

(58) Field of Classification Search
CPC .... E04B 1/61; E04B 2/721; E04B 2001/2684; E04B 2001/3583; E04C 2/46; E04H 9/14
See application file for complete search history.

(56) References Cited

U.S. PATENT DOCUMENTS 6,295,764 B1 10/2001 Berridge et al.
6,349,516 B1 2/2002 Powell et al.
6,425,220 B1 7/2002 Ashton et al.
6,820,388 B2 11/2004 Newhouse et al.
7,117,648 B1 10/2006 Pryor
2005/0055897 A1* 3/2005 Commins ..... E04H 9/14 52/169.1

FOREIGN PATENT DOCUMENTS

EP 0791113 A1 8/1997

OTHER PUBLICATIONS

Dayton Superior—Versiform® Gangforming System Application Guide (http://www.daytonsuperior.com/docs/default-source/application-guides/s_versiform_ag.pdf?sfvrsn=a6eedd60_11).
MevaLite—Adjustable Shearwall Bracket Technical Instruction Manual (http://www.mevaformwork.com/meva-media/docs/en/MevaLite-TIM-US.pdf).

* cited by examiner

*Primary Examiner* — Patrick J Maestri
(74) *Attorney, Agent, or Firm* — Roberts Calderon Safran & Cole P.C.

(57) ABSTRACT

A bracket assembly and installation method are provided that connects and reinforces upper and lower stud wall frames in a stacked relationship. The bracket assembly includes upper and lower brackets connectible across the width inside of a pair of parallel, aligned studs of the upper and lower stud wall frames, respectively, and a pair of post members that interconnect the upper and lower brackets. In the installation method, aligned openings are provided in the top plate of the lower stud wall frame and the bottom plate of the upper stud wall frame. The post members are inserted through the aligned openings and are connected between the first and second brackets to resist bending at the interface between the stacked upper and lower stud walls. Each bracket is length-adjustable to accommodate variations in the width between the pair of parallel studs.

22 Claims, 8 Drawing Sheets

BRACKET ASSEMBLY AND INSTALLATION METHOD FOR INTERCONNECTING STUD WALLS IN A STACKED RELATIONSHIP

FIELD

This invention generally relates to interior stud walls, and is specifically concerned with a bracket assembly and installation method for interconnecting and reinforcing upper and lower stud walls that are directly stacked together.

BACKGROUND

Stud walls are the most common type of interior walls used in buildings. Such walls generally comprise a stud frame formed from a series of vertically-oriented, uniformly-spaced studs of equal length that are connected together on their top and bottom ends by rail-like members referred to as top plates and a bottom plates, respectively. The resulting stud frame is covered on both sides by paneling such as drywall. Building codes typically limit the maximum length of the studs and the maximum spacing between studs to ensure that the resulting wall will have sufficient compressive strength to bear the loads expected to be applied to it. Building fire codes further require such stud walls to have a minimum bending strength in order to effectively resist the lateral forces applied to them by pressurized water from a firehose without detachment or collapse. The studs are formed either from wood or galvanized steel sheet material bent so as to have a "C"-shaped cross section. Such steel studs are specifically referred to as cold-formed steel or CFS studs, and have been gaining in popularity over wooden studs due to their higher strength per unit weight, greater dimensional stability, and superior fire and insect-resistance.

Typically, when stud walls are arranged in a stacked relationship in a multistory building, the intervening joists or I-beams between the top plate of the lower stud wall and the bottom plate of the upper stud wall that support the intervening floor provide a secure anchor point for the opposing top and bottom plates against any lateral forces applied to them. Such secure lateral anchoring, along with the bending resistance of the wooden or CFS studs and the minimum spacing requirements, ensure that both the upper and lower stacked walls will have the bending strength necessary to withstand any lateral pressure that might be applied to them by a firehose.

However, the necessary minimum bending strength may not be present in a stacked wall configuration where there are no intervening floor-support joists or I-beams, and the top plate of the lower stud wall and the bottom plate of the upper stud wall are directly connected together. Such a situation can occur, for example, when a remotely-constructed modular electrical room is installed in a building. Shipping constraints limit the height of such modular electrical rooms to about 11 feet. Since the floor-to-floor height of many buildings, such as data centers, is well over 11 feet, it is necessary to install a crown wall over the top of the stud walls of the modular electrical room in order to complete the room and structurally integrate it into the building. Even if the bottom plate of the lower stud wall and the top plate of the upper stud wall are securely anchored to a floor-supporting joist or I-beam, the interface between the directly-connected top and bottom plates may not comply with the minimum bending resistance specified by present day building fire codes. The problem is particularly acute when the upper and lower walls include CFS studs. In such walls, the top and bottom plates are rail-like members formed from steel sheet material bent to have a shallow, U-shaped cross section that receives the ends of the CFS studs. While such rail-like members have good compressive and bending resistance, they have relatively poor torsion resistance and thus are apt to twist when subjected to a lateral force.

SUMMARY

Accordingly, there is a need for bracket assembly that interconnects stud walls that are directly stacked on top of one another, and which further reinforces the bending strength of the stacked walls at their interface so that the interconnected stud walls comply with present day building codes. Ideally, such a bracket assembly should be easily installable despite variations in the distances between the studs, and should fit completely within the spaces between studs so as to be invisible after the drywall or other paneling is installed over the stud frames. Finally, the installation of the bracket assembly should not violate building codes limiting the location and size of any openings or cut-outs in the studs or top and bottom plates.

To these ends, the invention is a bracket assembly that connects the frames of upper and lower stud walls that are directly stacked together. The bracket assembly comprises upper and lower brackets, and at least one post member, each of which is installable within the space inside of a pair of parallel studs of the frames of the upper and lower stud walls that have been mutually aligned. The upper and lower brackets are connectible across the width of the pair of parallel studs of the frames of the upper and lower stud walls, respectively. The post member extends through aligned openings in the top plate of the lower stud frame and the bottom plate of the upper stud frame and is connected between the upper and lower brackets to rigidly connect the stacked upper and lower stud frames and to resist lateral bending at the connection interface.

Each of the brackets may be length-adjustable to accommodate variations in the width between the pair of parallel studs where they are mounted. Preferably, each of the first and second brackets includes inner and outer flanges that are slidably movable and fixable with respect to each other into a desired length. Each of the inner and outer flanges may include a mounting leg attachable over an inside surface of one of the pair of parallel studs, and a cross-width leg that is slidably movable over and fixable to the cross-width leg of the other flange of the bracket. Finally, each of the first and second brackets may include one or more sockets for connectively receiving the at least one post member.

The post member is preferably longer than the width across the pair of parallel studs of the upper and lower stud walls, and is more preferably about twice as long as this width. Such an aspect ratio prevents the ends of the interfacing stud members post member from applying concentrated leveraging forces to the post member. The flexural strength of the at least one post member is preferably equal to or greater than twice the flexural strength of one of the parallel studs. If two post members arranged in parallel are used in the inventive bracket assembly, each of the two post members will have a bending strength that is equal to or greater than the bending strength of one of the studs so that the combined bending strength of the post members equal to or greater than twice the flexural strength of one of the parallel studs. The positioning and the cross-sectional area of the at least one post member is selected to insure compliance with building codes limiting the location and size of any openings or cut-outs in the studs or top and bottom plates.

The invention further encompasses a method for installing the assembly bracket to a pair of stacked stud frames. In this method, a first bracket is connected across and inside a pair of parallel studs of one of the upper and lower stud frames. Next, an end of the at least one support post is extended through pre-provided aligned opening in the top plate of the lower stud wall and the bottom plate of the upper stud wall and connected to the first bracket. A second bracket is then across and inside a pair of parallel studs of the other of the upper and lower stud wall frames in close proximity to another end of the at least one support post. The other end of the support post is then to the second bracket.

In a preferred method of the invention, the first and second brackets are length adjustable, and the lengths of the first and second brackets are adjusted to fit between the pairs of parallel studs of the upper and lower stud wall frames at the time the first and second brackets are installed between studs. Also, each of the first and second brackets includes a socket for receiving an end of the at least one support post, and the support post is connected to each of the first and second brackets by securing its opposing ends into the socket of each bracket.

DETAILED DESCRIPTION OF THE PREFERRED EMBODIMENT

Figure 1:
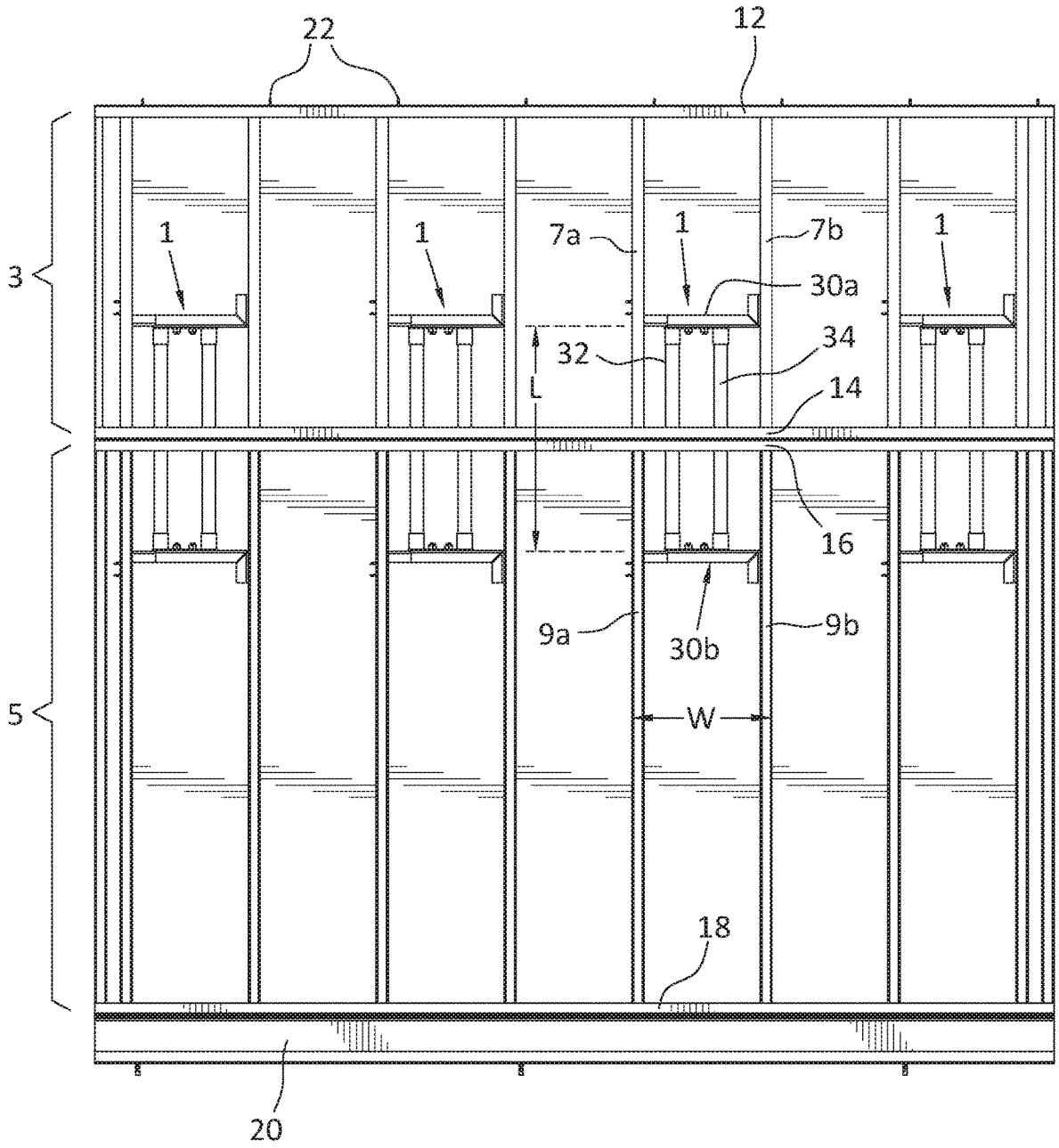
FIG. 1 is a front view illustrating the bracket assembly of the invention installed into a pair of stacked stud wall frames.
Figure 2A:
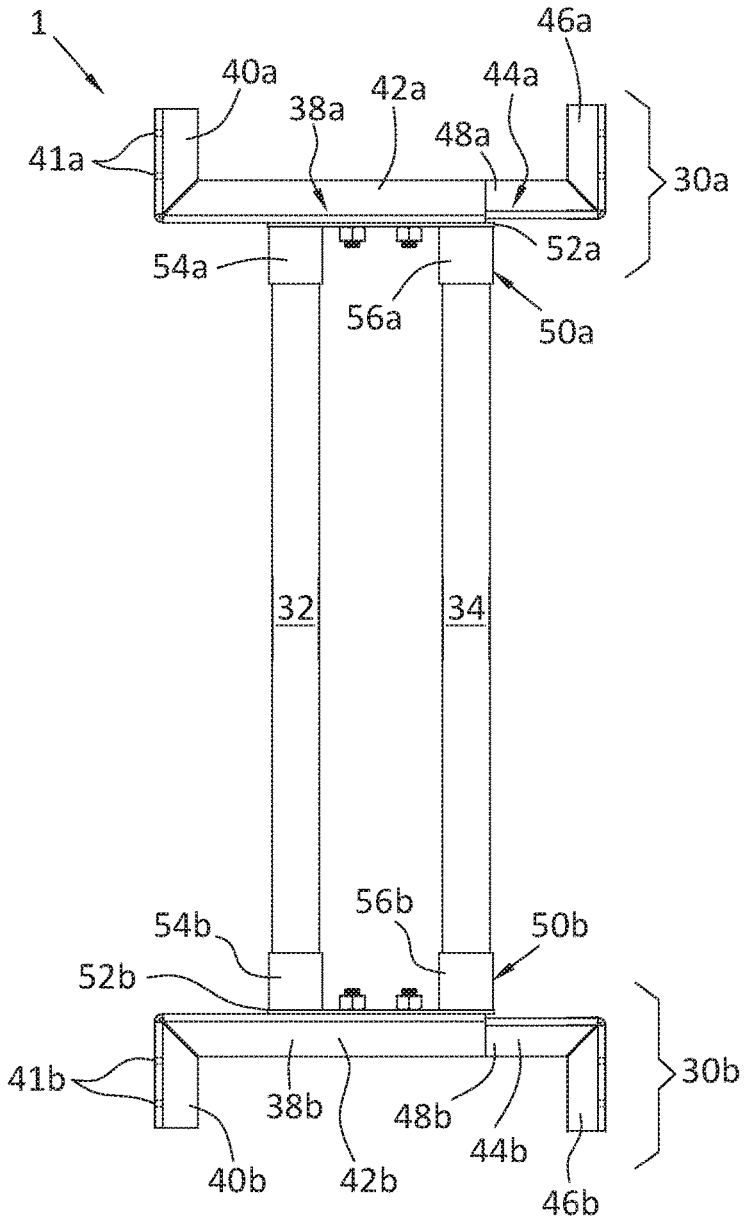
FIGS. 2A, 2B, and 2C are a front view, a side view and a top view of the bracket assembly.
Figure 2B:
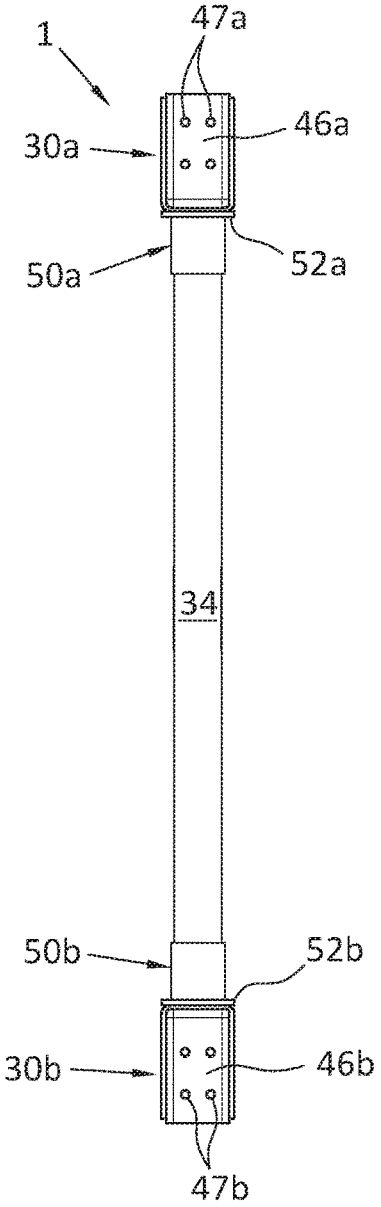
Figure 2C:
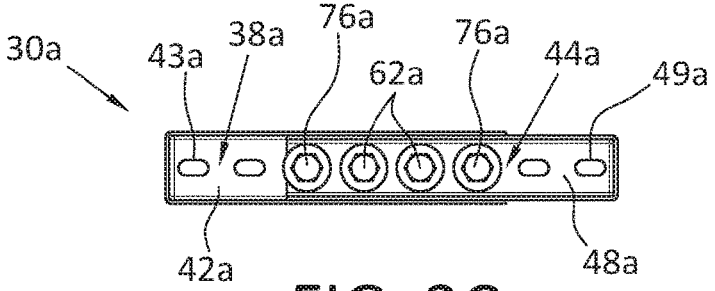

With reference now to FIG. 1, the invention is a bracket assembly 1 that interconnects and reinforces stacked upper and lower stud wall frames 3 and 5 in the region where they interface. Both the upper stud wall frame 3 and the lower stud wall frame 5 includes pairs of parallel studs 7*a*, 7*b* and 9*a*, 9*b*, respectively. The parallel studs 7*a*, 7*b* are the same length in the wall frame 3, as are the parallel studs 9*a*, 9*b* in the wall frame 5. In this example of the invention, the studs of the pairs 7*a*, 7*b* and 9*a*, 9*b* are cold-formed steel (CFS) studs having a "C" shaped cross-section, although the invention is also applicable to stud wall frames having wooden studs. Both the upper and lower wall frames 3 and 5 include top and bottom plates (sometimes referred to as "tracks") 12, 14 and 16, 18. Each of these plates 12, 14 and 16, 18 is formed from an elongated, rail-like member having a wide "U" shaped cross-section dimensioned to tightly receive the ends of their respective studs. The studs of the pairs 7*a*, 7*b* and 9*a*, 9*b* are in turn secured to their respective upper and lower plates 12, 14 and 16, 18 via screws (not shown). The studs of the pairs 7*a*, 7*b* and 9*a*, 9*b* are typically spaced apart a same distance in both wall frames (e.g. 15 inches) as a result of building code requirements. The resulting uniform spacing of the studs 7*a*, 7*b*, 9*a*, and 9*b* facilitates aligning the studs of the wall frames 3 and 5 in the manner illustrated, such that the stud pairs 7*a*, 7*b* of the upper wall frame 3 are aligned with the stud pairs 9*a*, 9*b* of the lower wall frame 5.

Further with reference to FIG. 1, the bracket assembly 1 is formed from upper and lower horizontally-disposed brackets 30*a* and 30*b*, and a pair of vertically-disposed support posts 32, 34. The support posts 32, 34 extend through holes 80*a*, 82*a* (shown in FIG. 8C) present in the bottom plate 14 of the upper wall frame 3 and the upper plate 16 of the lower wall frame 5. The upper and lower ends of the support posts 32, 34 are rigidly interconnected with the upper and lower brackets 30*a*, 30*b*. The upper and lower brackets 30*a*, 30*b* are fixedly mounted between their respective pairs of parallel studs 7*a*, 7*b*, 9*a*, 9*b* such that the bracket assembly 1 not only vertically interconnects the stacked upper and lower stud wall frames 3 and 5, but also mechanically reinforces the resulting combined stud wall frame against bending forces in the vicinity of the interfacing bottom plate 14 and top plate 16. To ensure that the bracket assembly 1 achieves such mechanical reinforcement, the preferred the length L of the support posts 32, 34 is at least as long as the width W of the pairs of parallel studs 7*a*, 7*b* and 9*a*, 9*b*, and more preferably, as is illustrated in FIG. 1, about twice as long as the width W. Such a minimum length L of the posts 32, 34 effectively disperses the concentrated leveraging forces that would otherwise occur if the stacked upper and lower stud wall frames 3 and 5 were connected (by bolts for example) only at the interface of the bottom plate 14 and top plate 16. Additionally, the upper and lower brackets 30*a*, 30*b* and support posts 32, 34 are dimensioned to fit completely within the space between the pairs of parallel studs 7*a*, 7*b*, 9*a*, 9*b*. Such dimensioning allows the bracket assembly 1 to be completely invisible after drywall or other paneling has been installed over the front and back surfaces of the stud wall frames 3 and 5. Finally, the bracket assembly 1 is preferably installed across every other pair of parallel studs 7*a*, 7*b* and 9*a*, 9*b*. The bracket assembly 1 is strong enough such that all that is needed to provide sufficient bending resistance to the combined wall frames 3, 5 is the staggered mounting configuration of FIG. 1.

FIGS. 2A-2C, FIG. 3, and FIG. 4A illustrate the components forming the brackets 30*a* and 30*b* and support posts 32, 34 of the bracket assembly 1. While the following description is confined to the components of upper bracket 30*a*, it applies equally to the components of the lower bracket 30*b* as the brackets 30*a*, 30*b* are identical in structure and operation.

Figure 3:
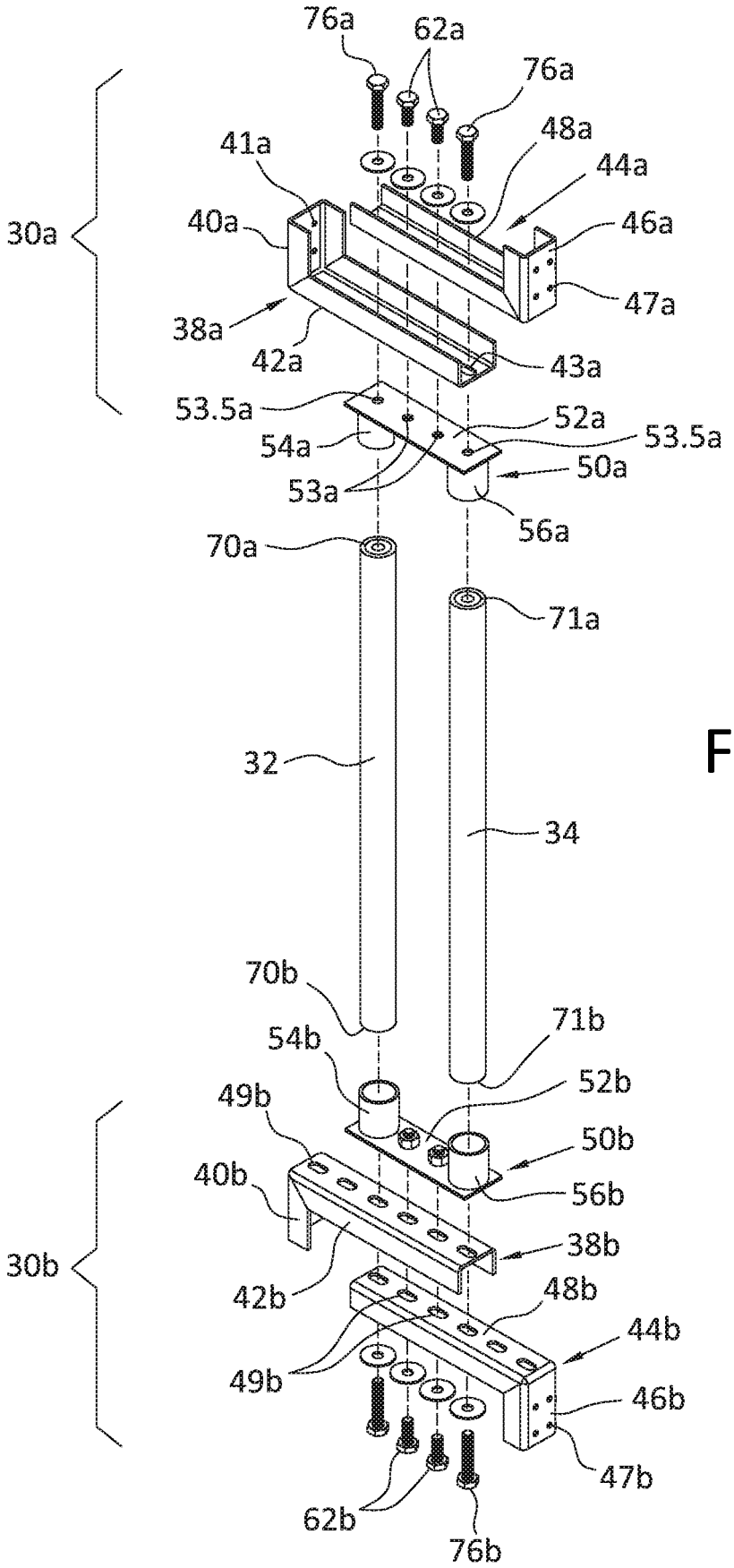
FIG. 3 is an exploded, perspective view of the bracket assembly.
Figure 4A:
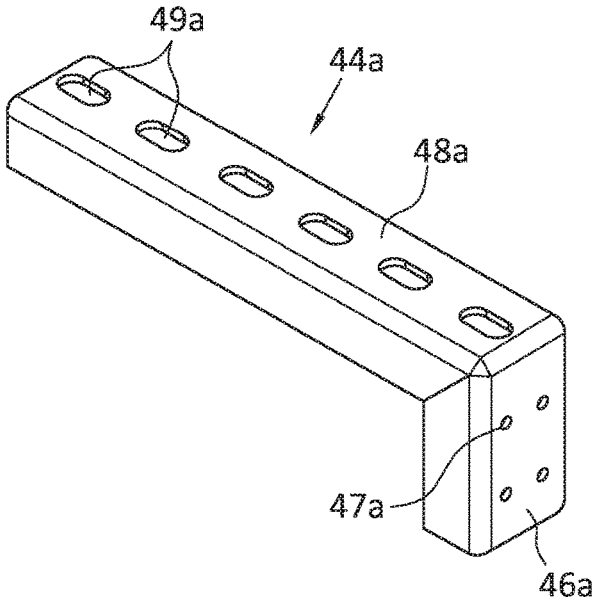
FIG. 4A is a perspective view of one of the two slidably interfitting flanges forming the upper bracket used in the bracket assembly.
Figure 4B:
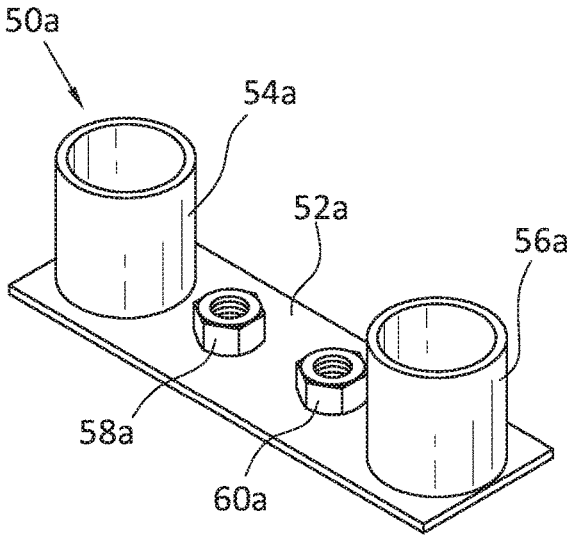
FIG. 4B is a perspective view of the post holder of the upper bracket of the bracket assembly.

With specific reference to FIGS. 3 and 4A, upper bracket 30*a* includes an outer flange 38*a*, an inner flange 44*a* received within and slidable movable over the outer flange 38*a*, and a support post holder 50*a*. Outer flange 38*a* has a vertically-oriented mounting leg 40*a* that includes bolt holes 41*a*, and a horizontally-oriented cross-width leg 42*a* having elongated bolt holes 43*a*. Inner flange 44*a* likewise includes a mounting leg 46*a* having bolt holes 47*a*, and a horizontally-oriented cross-width leg 48*a* having elongated holes 49*a* (best seen in FIG. 4A). With specific reference to FIGS. 3 and 4B, the support post holder 50*a* has a rectangular mounting plate 52*a* with two inner bolt holes 53*a* and two outer bolt holes 53.5*a* (shown in FIG. 3). A pair of annular sockets 54*a*, 56*a* are welded or otherwise secured to the inner face of the mounting plate 52*a* in concentric relationship with the two outer bolt holes 53.5*a*. A pair of mounting nuts 58*a*, 60*a* are also welded onto the inner face of the mounting plate 52*a* over the inner two bolt holes 53*a* in concentric relationship. As will be described in more detail hereinafter, the mounting nuts 58*a*, 60*a* of the support post holder 50*a* receive mounting bolts 62*a* through the inner bolt holes 53*a* in order to secure together the outer flange 38*a*, inner flange 44*a*, and support post holder 50*a*. Additionally, the bolt holes 53.5*a* receive mounting bolts 76*a* in order to mount the ends of the support posts 32, 34 into the sockets 54*a*, 56*a*.

Figure 4C:
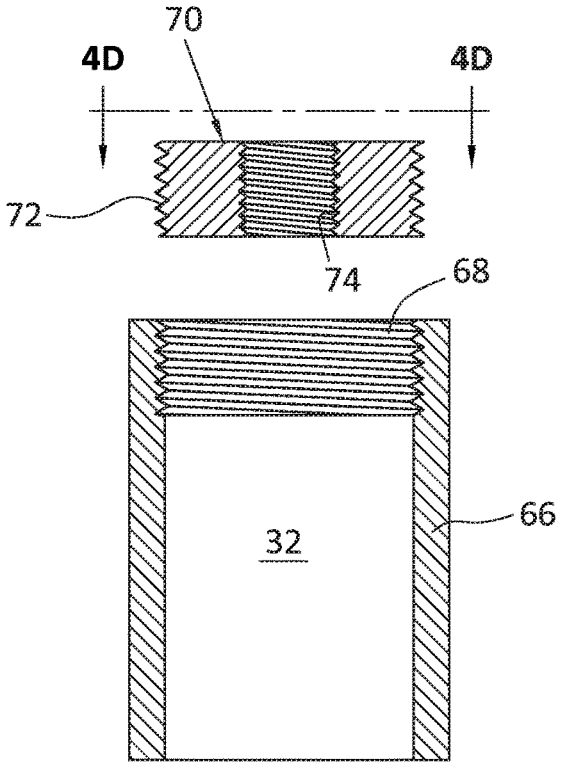
FIG. 4C is a cross-sectional side, exploded view of a top end of a support post and its end cap.
Figure 4D:
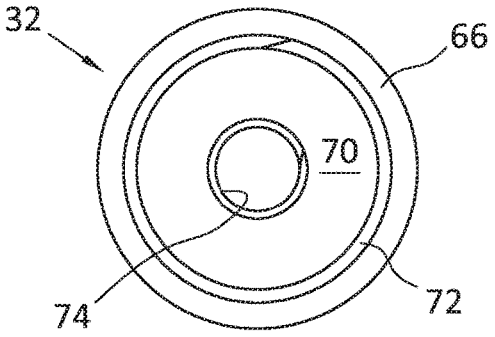
FIG. 4D is a top view of the support post and end cap along the line 4D-4D of FIG. 4C.

With specific reference to FIGS. 3, 4C, and 4D, the support posts 32, 34 are preferably formed from galvanized pipe stock, as such material has a relatively high bending strength, and is inexpensive and corrosion-resistant. For example, the support posts 32, 34 may be formed from 1.50 inch-dimeter galvanized pipe stock having a wall thickness of 0.125 inches. When used in stud wall frames where the pairs 7*a*, 7*b* and 9*a*, 9*b* of parallel studs are approximated 15 inches apart, the support posts 32, 34 may be 24 inches in length. The outer diameter of the support posts 32, 34 is slightly smaller than the inner diameter of the annular 54*a*, 56*a* sockets so that the support posts fit snugly in the sockets. As best seen in FIGS. 4C and 4D, each of the support posts 32, 34 includes a tubular body 66. The inner diameter 68 of both ends of the tubular body 66 of each of the support posts 32, 34 is threaded so as to receive end caps 70*a*, 70*b*; 71*a*, 71*b*, respectively. Each end cap 70*a*, 70*b*; 71*a*, 71*b* has a threaded outer diameter 72 for engaging the threaded inner diameter 68 of the support posts 32, 34, as well as a centrally-disposed threaded bore 74. As will be described in more detail hereinafter, the threaded bore 74 of each of the upper end caps 70*a*; 71*a*, receives mounting bolts 76*a* during the installation of the bracket assembly 1 that secure the support posts 32, 34 into the sockets 54*a*, 56*a* of the support post holder 50*a*.

FIGS. 5-9 illustrate an exemplary method of installing the bracket 1 into a pair of stacked stud wall frames 3 and 5.

Figure 5A:
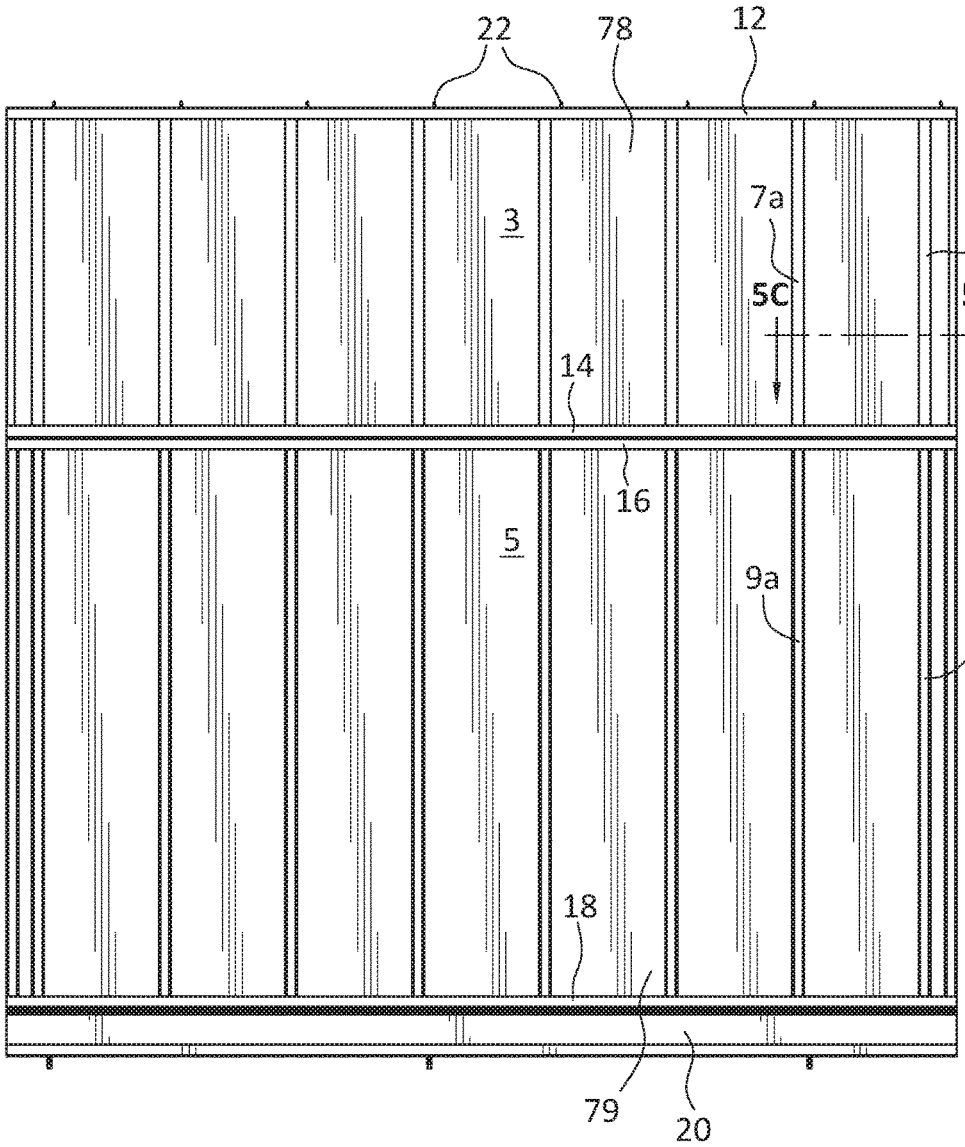
FIGS. 5A and 5B are front and side views of an upper stud wall frame that has been directly stacked over a lower stud wall frame with their respective pairs of studs in mutual alignment before the installation of the bracket assembly of the invention.
Figure 5B:
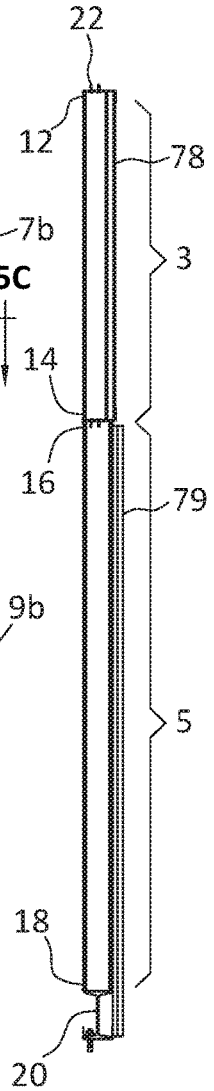
Figure 5C:
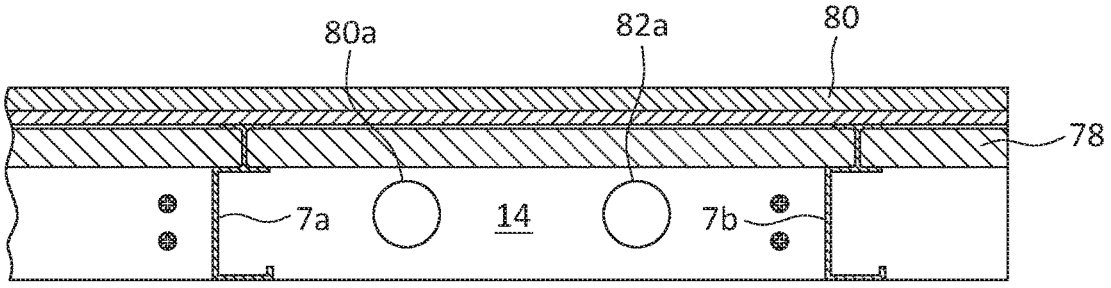
FIG. 5C is a cross-sectional plan view of a pair of studs of the upper stud frame wall along the lines 5C-5C.

As is illustrated in FIGS. 5A and 5B, in the first steps of the installation method, upper 3 and lower 5 stud wall frames are arranged in a stacked relationship with the bottom plate 14 of the upper frame 3 flush against the upper plate 16 of the lower frame 5, and with the stud pairs 7*a*, 7*b* of the upper wall frame 3 aligned with the stud pairs 9*a*, 9*b* of the lower wall frame 5. In this example of the invention, the lower plate 18 of the lower frame 5 is secured to the upper flange of a support beam 20 via bolts (not shown). The bottom plate 14 of the upper frame 3 is attached to the upper plate 16 of the lower frame 5 as is illustrated in FIG. 5B. The upper plate 12 of the upper frame 3 is anchored to a ceiling joist or other ceiling structural member (not shown) via bolts 22. Drywall paneling 78, 79 is attached over the back faces of the stud wall frames 3 and 5 as shown, leaving the front faces open. Finally, as is shown in FIG. 5C, openings 80, 82 in the form of circular holes are punched through the lower plate 14 and upper plate 16 of the upper and lower stud wall frames 3 and 5, respectively. Each opening 80, 82 is in fact a pair of aligned, circular holes in both the lower plate 14 and the upper plate 16. For reasons that will be explained shortly, the inner diameter of each of the openings 80, 82 is slightly larger than the outer diameter of the support posts 32, 34.

Figure 6A:
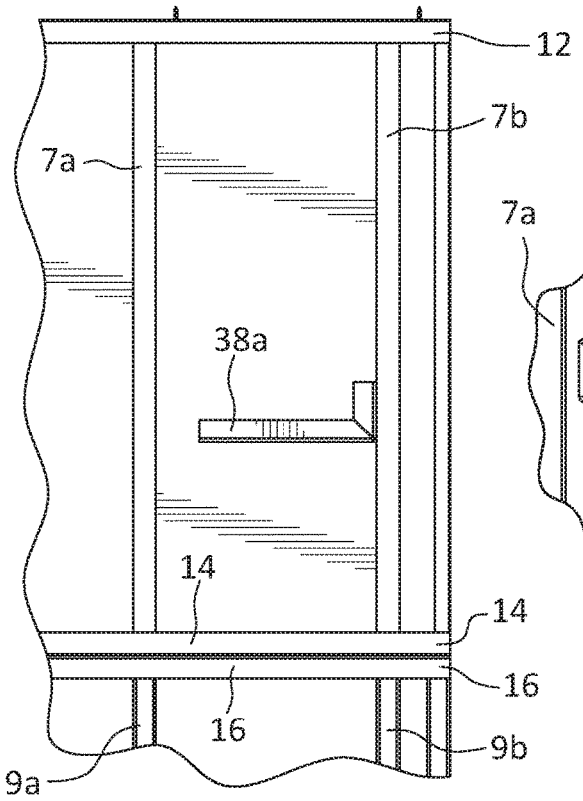
FIGS. 6A and 6B are front and perspective views of the outer flange of the upper bracket being installed in the space between two studs of the upper stud wall frame.
Figure 6B:
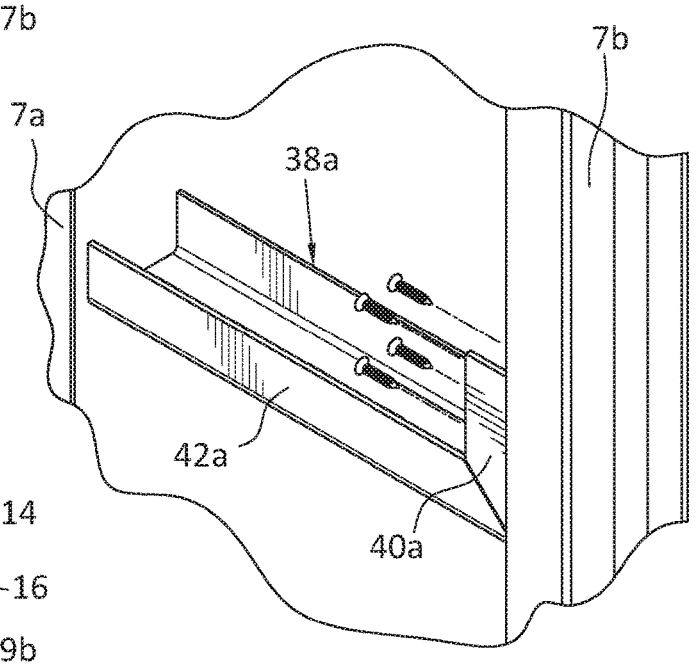
Figure 6C:
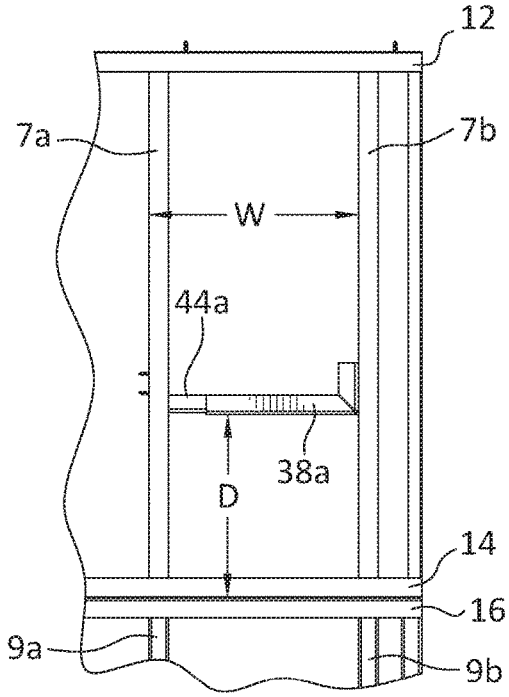
FIGS. 6C and 6D are front and perspective views of the inner flange of the upper bracket being installed in the space between two studs of the upper stud wall frame.
Figure 6D:
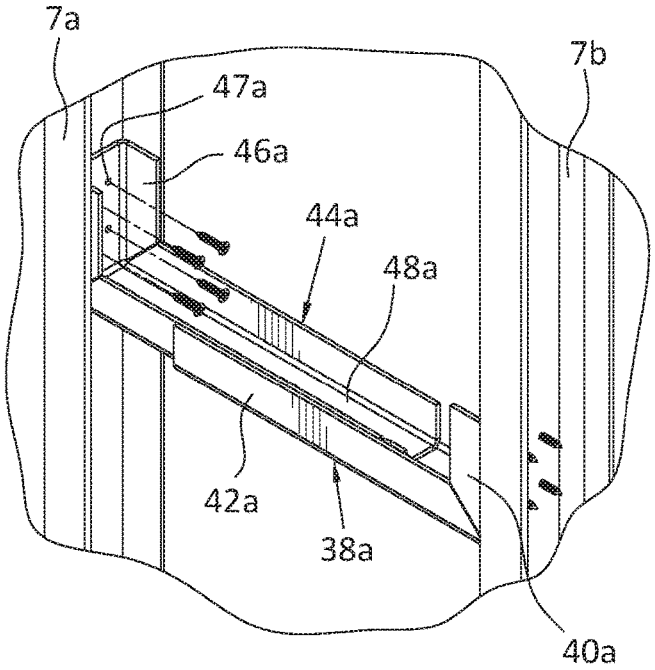

With reference now to FIGS. 6A-6D, the upper bracket 30*a* is next installed between the stud pair 7*a*, 7*b* of the upper wall 3. Outer flange 38*a* is first affixed to the inner surface of the stud 7*b* via screws that extend through the screw holes 41*a* of mounting leg 40*a*. Next, the cross-width leg 48*a* of the inner flange 44*a* is slidably received into the cross-width leg 42*a* of the outer flange 38*a*, and the mounting leg 46*a* is slid into abutment with the inner surface of the stud 7*a*. The inner flange 44*a* is then affixed to the inner surface of the stud 7*a* via screws that extend through the screw holes 47*a* of mounting leg 46*a*. The shape and frequency of the elongated bolt holes 49*a* in the cross-width leg 48*a* of the inner flange 44*a* and the elongated bolt holes 43*a* the cross-width leg 42*a* of the outer flange 38*a* are chosen such that, when the outer and inner flanges 38*a*, 44*a* of the upper bracket 30*a* are mounted as shown in FIGS. 6C and 6D, the elongated bolt holes 43*a*, 49*a* sufficiently align so as to provide bolt hole openings in registration with the mounting nuts 58*a*, 60*a* of the support post holder 50*a*. As shown in FIG. 6C, the upper bracket 30*a* is installed a distance D from the interface between the upper plate 14 and lower plate 16 that is about the same as the width W of the stud pair 7*a*, 7*b*.

Figure 7A:
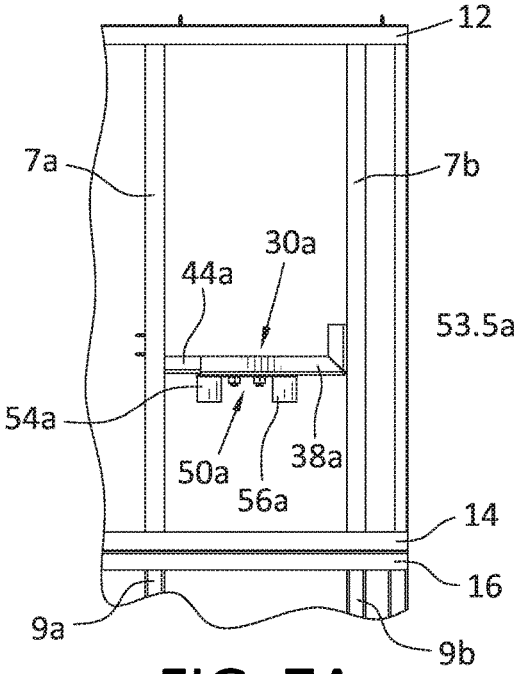
FIGS. 7A and 7B are front and perspective views of the support post holder being assembled to the upper bracket.
Figure 7B:
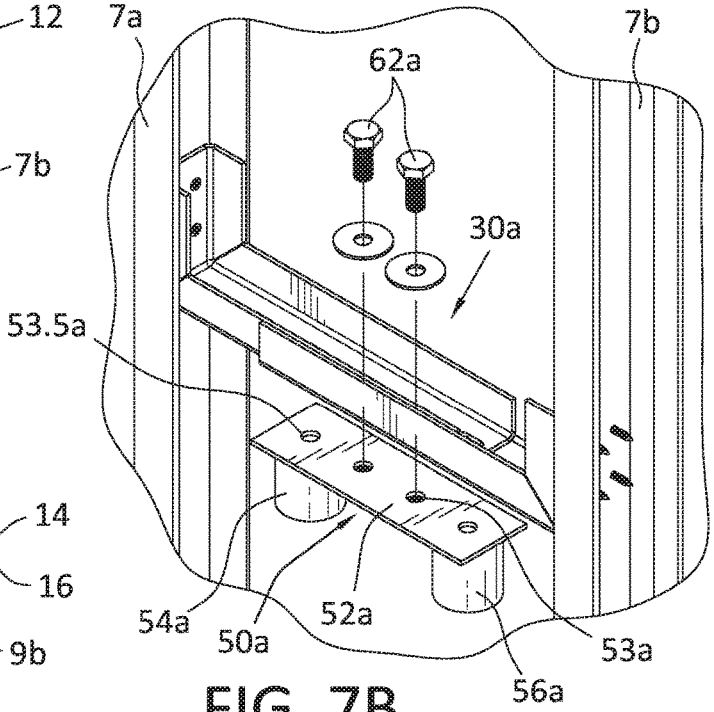

With reference now to FIGS. 7A and 7B, the support post holder 50*a* is next affixed to the outer and inner flanges 38*a* and 44*a* via the mounting bolts 62*a*. This is accomplished by inserting the mounting bolts 62*a* first through the bolt hole openings provided by the overlapping, elongated bolt holes 43*a*, 49*a* provided in the cross-width legs 42*a*, 48*a* of the outer and inner flanges 38*a*, 44*a*, and then through the bolt holes 53.5*a* in the mounting plate 52*a* of the support post holder 50*a*. The mounting bolts 62*a* are then screwed and snugged into the mounting nuts 58*a*, 60*a* of the support post holder 50*a*. This completes the assembly of the upper bracket 30*a*. It should be noted that the relative slidability of the outer and inner flanges 38*a*, 44*a* in combination with the chosen geometry and spacing of the elongated bolt holes 49*a* of the inner flange 44*a* and the elongated bolt holes 43*a* of the outer flange 38*a* provides a width-wise adjustability to both the upper and lower brackets 30*a*, 30*b* of the bracket assembly 1. This is turn advantageously allows the bracket assembly 1 to accommodate stud wall frames having stud pairs of varying widths.

Figure 8A:
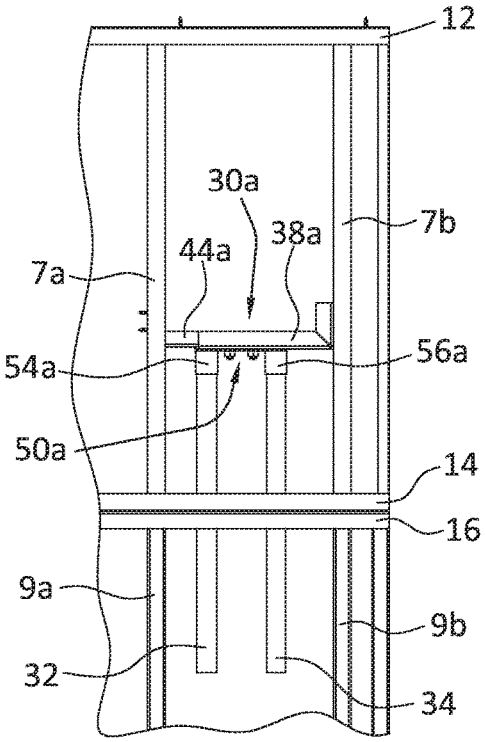
FIG. 8A is a front view of the upper ends of the support posts assembled to the support post holder.
Figure 8B:
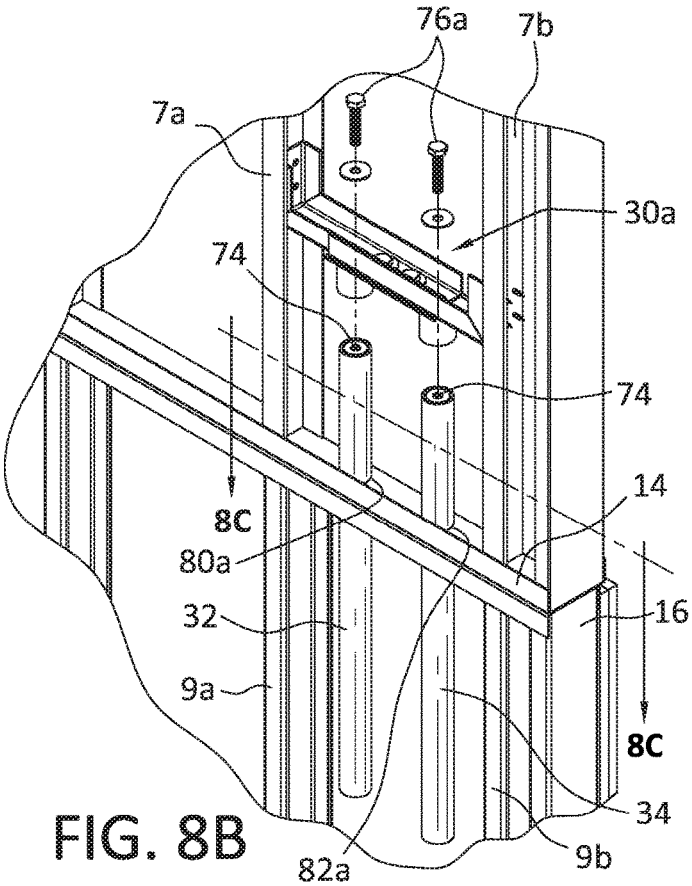
FIG. 8B is a perspective view of the support posts being assembled to the support post holder.
Figure 8C:
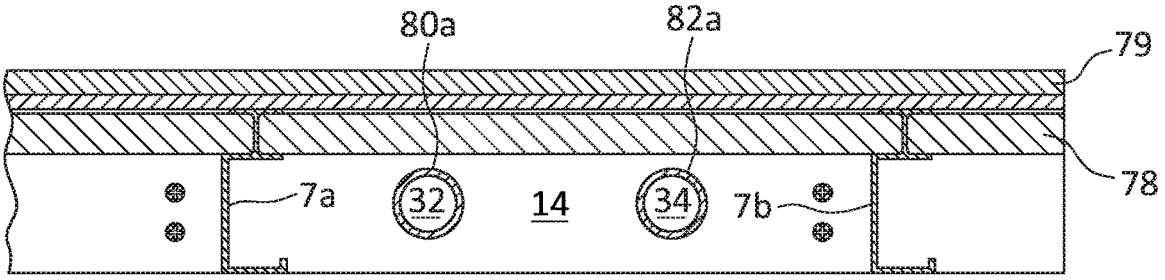
FIG. 8C is a plan, cross sectional view of FIG. 8A along the line 8C-8C illustrating the openings provided in the lower and upper plates of the upper and lower stud wall frames that the support posts extend through, and FIG. 9 is a perspective view of the support post holder of the lower bracket being assembled to the lower ends of the support posts.

With reference now to FIGS. 8A and 8B, the support posts 32, 34 are next connected to the support post holder 50*a*. This is accomplished by sliding the support posts 32, 34 through the openings 80, 82 in the upper and lower plates 14, 16 and inserting them into the annular sockets 54*a*, 56*a* of the support post holder 50*a*. Mounting bolts 76*a* are then inserted through the bolt holes 53.5*a* in the mounting plate 53*a* of the support post holder 50*a*, thereby aligning them with the threaded bores 74 of the end caps 70*a* and 71*a* of the support posts 32, 34. Bolts 76*a* are then screwed and snugged into the threaded bores 74, thereby securing the top ends of the support posts 32, 34 to the upper bracket 30*a*. FIG. 8C illustrates the preferred, relatively close (i.e. about $3/32^{nds}$ of an inch) spacing between the outer diameter of the support posts 32, 34 and the openings 80, 82 through the upper and lower plates 14, 16. Such close spacing allows the upper and lower plates 14, 16 to reinforce the bending strength of the combined, stacked stud wall frames 3 and 5. Specifically, such close spacing allows the edges of the openings 80, 82 to flex into contact with the support posts 32, 34 when a bending force is applied the stacked stud wall frames 3 and 5, which in turn allows the lateral resistance of the support posts 32, 34 to reinforce the upper and lower plates 14, 16 against bending further.

Figure 9:
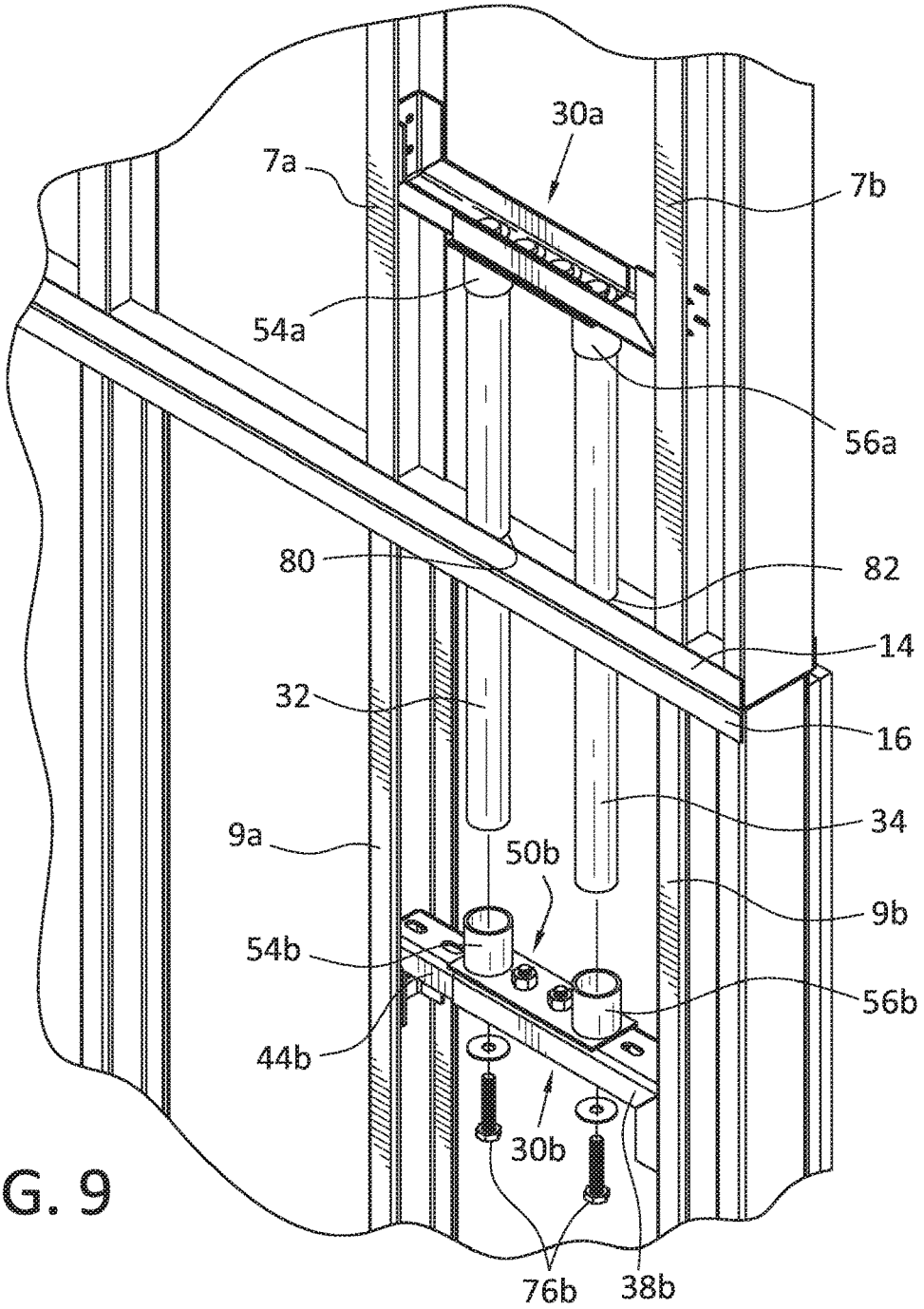

In the final installation steps of the bracket assembly 1, the outer flange 38*b*, the inner flange 44*b*, and the support post holder 50*b* of the lower bracket 30*b* are loosely stacked together in the configuration shown in FIG. 9. These loosely stacked parts of the lower bracket 30*b* are then positioned below the lower ends of the support posts 32, 34 and between the pair of studs 9*a* and 9*b* as shown, and then are lifted upwardly until the annular sockets 54*b*, 56*b* receive the lower ends of the support posts 32, 34. Mounting bolts 76*b* are inserted upwardly through the elongated holes 43*b* and 49*b* of the outer flange 38*b* and inner flange 44*b*, respectively, and through the outer bolt holes 53.5*b* in the mounting plate 52*b* of the support post holder 50*b*. Mounting bolts 76*b* are then loosely screwed into the threaded bores 74 of the end caps 70*b*, 71*b*. Once this is accomplished, the loosely assembled lower bracket 30*b* is suspended from the bottom ends of the support posts 32, 34 in the position illustrated in FIG. 1. Next, the outer flange 38*b* and inner flange 44*b* are slidably adjusted so that their respective mounting legs 40*b*, 46*b* are abutted flush against the inner side walls of the studs 9*b*, 9*a*, respectively. The mounting legs 40*b*, 46*b* are next affixed to the side walls of the studs 9*b*, 9*a* by screws in the same fashion as described with respect to the upper bracket 30*a*. Mounting bolts 62*b* are then inserted through inner bolt holes 53*b* of the mounting plate 52*b* of the support post holder 50*b*, and loosely screwed into the mounting nuts 58*b*, 60*b*. In the last installation steps, mounting bolts 76*b* are tightened to snug the lower ends of the support posts 32, 34 into the annular sockets 54*b*, 56*b*, and the mounting bolts 62*b* are tightened to snug together the outer flange 38*b*, the inner flange 44*b*, and the support post holder 50*b*.

As shown in FIG. 1, the bracket assembly 1 is preferable installed across every other pair of parallel studs 7*a*, 7*b* and 9*a*, 9*b*. The bracket assembly 1 is strong enough such that all that is needed to provide sufficient bending resistance to the combined wall frames 3, 5 is the staggered mounting configuration of FIG. 1.

While elongated bolt holes such as 43*a*, 43*b* and 49*a*, 49*b* are used in the upper and lower brackets 30*a*, 30*b* to afford width-wise adjustability, it should be noted that slots could also be used for this purpose.

The invention claimed is:

1. A bracket assembly that connects upper and lower stud wall frames arranged in a stacked relationship, wherein each stud wall frame includes a pair of parallel studs interconnecting a top plate and a bottom plate, the parallel studs of the upper and lower stud wall frames being mutually aligned, comprising:

upper and lower brackets connectible across the width inside of the pair of parallel, aligned studs of the upper and lower stud walls, respectively, and at least one post member extending through aligned openings in the top plate of the lower stud wall frame and the bottom plate of the upper stud wall frame and connected between the upper and lower brackets to resist bending at an interface between the stacked upper and lower stud wall frames, wherein each of the brackets is length-adjustable to accommodate variations in the width between the pair of parallel studs.

2. The bracket assembly of claim 1, wherein a length of the at least one post member is longer than the width across the pair of parallel studs of the upper and lower stud wall frames.

3. The bracket assembly of claim 1, wherein a flexural strength of the at least one post member is equal to or greater than a flexural strength of one of the parallel studs.

4. The bracket assembly of claim 1, wherein each of the upper and lower brackets includes inner and outer flanges that are slidably movable and fixable with respect to each other into a desired length.

5. The bracket assembly of claim 4, wherein each of the inner and outer flanges includes a mounting leg attachable over an inside surface of one of the pair of parallel studs, and a cross-width leg that is slidably movable over and fixable to the cross-width leg of the other flange of the bracket.

6. The bracket assembly of claim 1, wherein each of the upper and lower brackets includes a socket for connectively receiving the at least one post member.

7. The bracket assembly of claim 1, comprising two post members, each of which extends through aligned openings in the top plate of the lower stud wall frame and the bottom plate of the upper stud wall frame and interconnects the upper and lower brackets.

8. The bracket assembly of claim 7, wherein the two post members are parallel and are uniformly spaced across the width inside of the pair of parallel studs of the upper and lower stud wall frames, respectively.

9. The bracket assembly of claim 1, wherein the studs in the upper and lower stud wall frames are CFS studs.

10. A bracket assembly that connects upper and lower stud wall frames in a stacked relationship, wherein each stud wall frame includes at least one pair of parallel studs interconnecting a top plate and a bottom plate, and the at least one pair of parallel studs of the upper and lower stud wall frames are in alignment, comprising:

upper and lower brackets connectible across the width inside of the pair of parallel studs of the upper and lower stud wall frames, respectively, each bracket being length-adjustable to accommodate variations in the width between the pair of parallel studs, and at least one post member extending through aligned openings in the top plate of the lower stud wall frame and the bottom plate of the upper stud wall frame and connected between the first and second brackets to resist bending at an interface between the stacked upper and lower stud wall frames, wherein a length of the at least one post member is longer than the width across the pair of parallel studs of the upper and lower stud wall frames.

11. The bracket assembly of claim 10, wherein each of the brackets is disposed within the space defined between the pair of parallel studs of the upper and lower stud wall frames.

12. The bracket assembly of claim 10, wherein each of the upper and lower brackets includes inner and outer flanges that are slidably movable and fixable with respect to each other into a desired length.

13. The bracket assembly of claim 10, comprising two post members, each of which extends through aligned openings in the top plate of the lower stud wall frame and the bottom plate of the upper stud wall frame and interconnects the upper and lower brackets.

14. The bracket assembly of claim 13, wherein the two post members are parallel and are uniformly spaced across the width inside of the pair of parallel studs of the upper and lower stud wall frames, respectively.

15. A method of installing a bracket assembly to connect upper and lower stud wall frames arranged in a stacked relationship, wherein each stud wall frame includes at least one pair of parallel studs interconnecting a top plate and a bottom plate, comprising the steps of:

providing aligned openings in the top plate of the lower stud wall frame and the bottom plate of the upper stud wall frame;

connecting a first bracket across and inside the pair of parallel studs of one of the upper and lower stud wall frames;

inserting a support post through the aligned openings in the top plate of the lower stud wall frame and the bottom plate of the upper stud wall frame and connecting an end of the support post to the first bracket;

connecting a second bracket across and inside the pair of parallel studs of the other of the upper and lower stud wall frames, and connecting the other end of the support post to the second bracket, wherein end edges of the support post are directly and fixedly connected to the first and second brackets, respectively, such that a distance between the first and second brackets is fixed.

16. The method of installing a bracket assembly to connect upper and lower stud wall frames arranged in a stacked relationship of claim 15, wherein the first and second brackets are length adjustable, and wherein the lengths of the first and second brackets are adjusted to fit between the pairs of parallel studs of the upper and lower stud wall frames at the time the first and second brackets are connected.

17. The method of installing a bracket assembly to connect upper and lower stud wall frames arranged in a stacked relationship of claim 15, wherein each of the first and second brackets includes a socket to receive an end of the support post, and the support post is connected to each of the first and second brackets by securing its opposing ends into the socket of each bracket.

18. The method of installing a bracket assembly to connect upper and lower stud wall frames arranged in a stacked relationship of claim 15, wherein each of the upper and lower stud wall frames includes a plurality of pairs of parallel studs that are substantially in registration, and wherein the bracket assembly is installed between every other pair of registered studs.

19. The method of installing a bracket assembly to connect upper and lower stud wall frames arranged in a stacked relationship of claim 15, further including the step of directly and fixedly connecting opposing end edges of a second support post between the first and second brackets after inserting the second support post through second aligned openings in the top plate of the lower stud wall frame and the bottom plate of the upper stud wall frame.

20. A bracket assembly in combination with upper and lower stud wall frames arranged in a stacked relationship, wherein each stud wall frame includes a pair of parallel studs interconnecting a top plate and a bottom plate, the parallel studs of the upper and lower stud wall frames being mutually aligned, comprising:

a stud bay defined between the width inside of the pair of parallel, aligned studs of the upper and lower stud walls, respectively, upper and lower brackets connectible across the width inside the stud bay of the pair of parallel, aligned studs of the upper and lower stud walls, respectively, and at least one post member extending through aligned openings in the top plate of the lower stud wall frame and the bottom plate of the upper stud wall frame and connected between the upper and lower brackets to resist bending at an interface between the stacked upper and lower stud wall frames, wherein a length of the at least one post member is between about one and two widths of the parallel, aligned studs of the upper and lower stud walls.

21. A bracket assembly that connects upper and lower stud wall frames arranged in a stacked relationship, wherein each stud wall frame includes a pair of parallel studs interconnecting a top plate and a bottom plate, the parallel studs of the upper and lower stud wall frames being mutually aligned, comprising:

upper and lower brackets connectible across the width inside of the pair of parallel, aligned studs of the upper and lower stud walls, respectively, and at least one post member extending through aligned openings in the top plate of the lower stud wall frame and the bottom plate of the upper stud wall frame and connected between the upper and lower brackets to resist bending at an interface between the stacked upper and lower stud wall frames, wherein end edges of the post member are directly and affixedly connected to the upper and lower brackets such that the distance between the upper and lower brackets is fixed.

22. The bracket assembly of claim 21, wherein the end edges of the post member are directly connected in abutting contact with the upper and lower brackets and are affixed thereto to resist shear forces applied between the upper and lower brackets and the post member.

* * * * *